US012774576B2

(12) United States Patent
Zock

(10) Patent No.: US 12,774,576 B2
(45) Date of Patent: Oct. 27, 2026

(54) NONWOVEN COMPOSITE GEOTEXTILE SILT FENCE FOR TRENCH AND TRENCHLESS INSTALLATION AND GEOTEXTILE THEREFORE

(71) Applicant: BLUROCK INVESTMENTS, LLC, Saxonburg, PA (US)

(72) Inventor: Michael A Zock, Saxonburg, PA (US)

(73) Assignee: BluRock Investments, LLC, Saxonburg, PA (US)

( * ) Notice: Subject to any disclaimer, the term of this patent is extended or adjusted under 35 U.S.C. 154(b) by 83 days.

(21) Appl. No.: 18/899,608

(22) Filed: Sep. 27, 2024

(65) Prior Publication Data

US 2025/0101703 A1 Mar. 27, 2025

Related U.S. Application Data

(60) Provisional application No. 63/540,865, filed on Sep. 27, 2023.

(51) Int. Cl.

| | |
|---|---|
| ***E02D 17/20*** | (2006.01) |
| ***D04H 1/425*** | (2012.01) |
| ***D04H 1/435*** | (2012.01) |
| ***D04H 1/4382*** | (2012.01) |
| ***D04H 1/46*** | (2012.01) |

(52) U.S. Cl.

CPC ..... *E02D 17/202* (2013.01); *D04H 1/425* (2013.01); *D04H 1/435* (2013.01); *D04H 1/43835* (2020.05); *D04H 1/46* (2013.01)

(58) Field of Classification Search

CPC ..... E02D 17/202; E02B 3/125; E02B 3/126; D04H 1/425; D04H 1/435; D04H 1/43835; D04H 1/46

See application file for complete search history.

(56) References Cited

U.S. PATENT DOCUMENTS

| | | | | |
|---|---|---|---|---|
| 2006/0133900 | A1* | 6/2006 | Singleton | E02D 17/20 405/302.7 |
| 2014/0066872 | A1* | 3/2014 | Baer | D04H 1/492 28/169 |
| 2016/0201239 | A1* | 7/2016 | Baer | D04H 1/425 156/60 |
| 2019/0145068 | A1* | 5/2019 | Zock | E01F 7/02 256/12.5 |
| 2019/0352867 | A1* | 11/2019 | Schaaf | E02B 8/023 |
| 2023/0035252 | A1* | 2/2023 | Singleton | E02B 3/04 |

(Continued)

OTHER PUBLICATIONS

Stevens, Ellen; Barfield, Billy J.; Britton, S.L.; Hayes, J.S. (Sep. 2004). Filter Fence Design Aid for Sediment Control at Construction Sites (Report). Cincinnati, OH: U.S. Environmental Protection Agency (EPA).

(Continued)

*Primary Examiner* — Amber R Anderson
*Assistant Examiner* — Stacy N Lawson
(74) *Attorney, Agent, or Firm* — Blynn L. Shideler; Krisanne Shideler; BLK Law Group

(57) ABSTRACT

A silt fence includes a plurality of spaced stakes; and a nonwoven needle punched geotextile including a combination of a synthetic fiber blend and natural fibers, wherein the synthetic fiber blend includes a blend of polypropylene fibers and high tenacity polyester fibers.

17 Claims, 7 Drawing Sheets

(56) References Cited

U.S. PATENT DOCUMENTS

| | | | | |
|---|---|---|---|---|
| 2023/0087094 | A1* | 3/2023 | Jones | D04H 1/4291<br>442/205 |
| 2025/0075459 | A1* | 3/2025 | Ray | E02D 17/02 |

OTHER PUBLICATIONS

"Chapter 2. Erosion and Sediment Control Principles, Practices and Costs" (PDF). Virginia Erosion and Sediment Control Handbook (Report) (3rd Ed.). Richmond, VA: Virginia Department of Environmental Quality (VA DEQ). 1992.

Silt Fences (PDF) (Report). Stormwater Best Management Practice. Washington, D.C.: EPA. 2012. EPA 833-F-11-008.

Brzozowski, Carol (Nov.-Dec. 2006). "Silt Fence Installation". Erosion Control. Forester Media. 13 (7).

* cited by examiner

FIG. 10
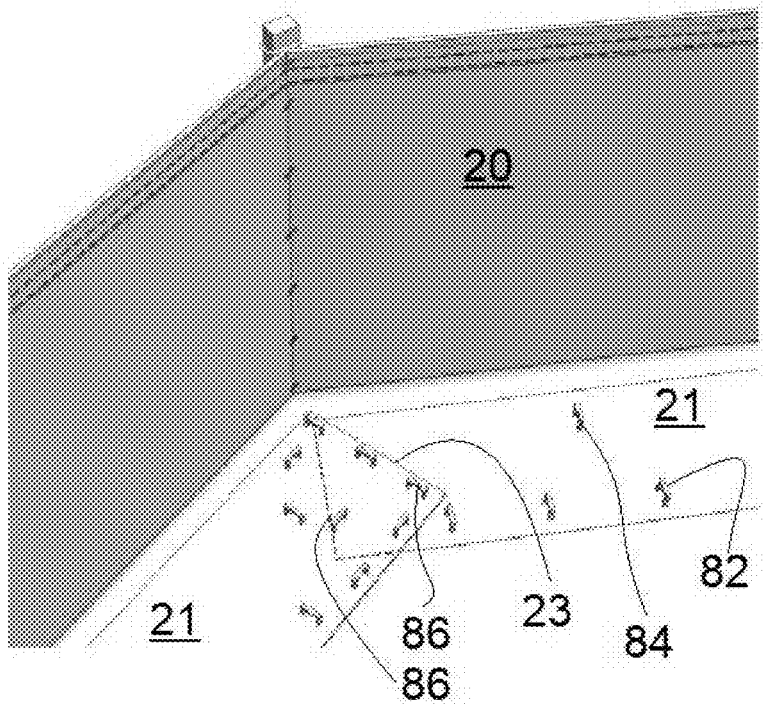
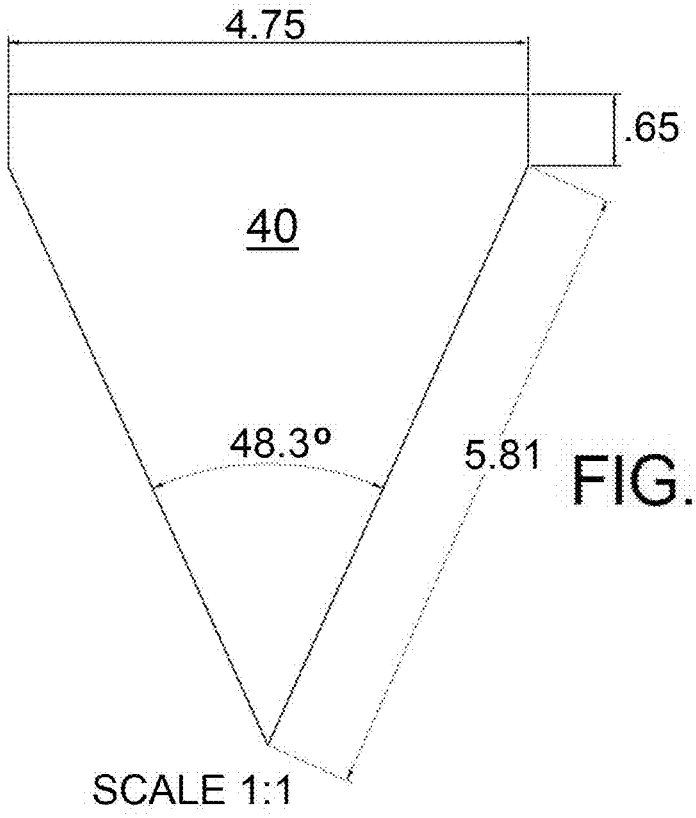
FIG. 12

NONWOVEN COMPOSITE GEOTEXTILE SILT FENCE FOR TRENCH AND TRENCHLESS INSTALLATION AND GEOTEXTILE THEREFORE

RELATED APPLICATIONS

This application claims priority to U.S. provisional patent application Ser. No. 63/540,865 filed Sep. 27, 2023, titled "Nonwoven Composite Geotextile Silt Fence and Geotextile Therefore" which application is incorporated herein by reference in its entirety.

BACKGROUND INFORMATION

1. Field of the Invention

The present invention relates to a silt fence and more particular to a non-woven composite geotextile silt fence, more particularly to a non-woven composite geotextile silt fence for trench and trenchless implementations.

2. Background Information

The present invention relates to the general and overlapping fields of erosion, sediment and pollution control. Erosion control, broadly, is the practice of preventing or controlling wind or water erosion in agriculture, land development, coastal areas, river banks and construction. Effective erosion controls handle surface runoff and are important techniques in preventing water pollution, soil loss, wildlife habitat loss and human property loss. Sediment control is a practice designed to keep eroded soil within a perimeter, namely on a construction site, so that it does not wash off and cause water pollution to a nearby stream, river, lake, or sea. Sediment controls are usually employed together with erosion controls, which are designed to prevent or minimize erosion. Sediment controls are generally designed to be temporary measures, however, some can also be used for storm water management purposes. Pollution control, in the context of this application, is the removal or limiting of specific contaminants within surface waters, and pollution control devices may be implemented with, or integrated within, erosion and sediment control devices.

A silt fence is a temporary sediment control device used on construction sites to protect water quality in nearby streams, rivers, lakes and seas from sediment (loose soil) in stormwater runoff. Silt fences are widely used on construction sites in North America and elsewhere, due to their low cost and simple design. See Stevens, Ellen; Barfield, Billy J.; Britton, S. L.; Hayes, J. S. (September 2004). Filter Fence Design Aid for Sediment Control at Construction Sites (Report). Cincinnati, OH: U.S. Environmental Protection Agency (EPA).

A silt fence is often installed as a perimeter control, i.e. around a perimeter of an area of interest. They are often used in combination with sediment basins and sediment traps, as well as with erosion controls, which are designed to retain sediment in place where soil is being disturbed by construction processes (i.e., land grading and other earthworks). See "Chapter 2. Erosion and Sediment Control Principles, Practices and Costs" (PDF). Virginia Erosion and Sediment Control Handbook (Report) (3rd ed.). Richmond, VA: Virginia Department of Environmental Quality (VA DEQ). 1992.

A typical silt fence consists of a piece of synthetic filter fabric, also called a geotextile, stretched between a series of wooden or metal fence stakes along a horizontal contour level. The stakes are installed on the downhill side of the silt fence, and the bottom edge of the fabric is trenched into the soil and backfilled on the uphill side. The design/placement of the silt fence should create a pooling of runoff, which then allows sedimentation to occur. Water can seep through the silt fence fabric, but the fabric often becomes "blocked off" with fine soil particles (all sediment-retention devices have this challenge, and none of them "filter" storm water for very long). A few hours after a storm event, the fabric can be "disturbed" in order to dislodge the fines, and allow clean water to flow through. Depending on the protected watershed and erosion, larger soil particles will settle out, ultimately filling the silt fence to the top of the structure; requiring another silt fence above or below it (creating a new ponding area), or for the silt fence to be removed, the sediment removed or spread out, and a new fence installed. The fence is not designed to concentrate or channel stormwater. The fence is installed on a site before soil disturbance begins, and is placed down-slope from the disturbance area. See Silt Fences (PDF) (Report). Stormwater Best Management Practice. Washington, D.C.: EPA. 2012. EPA 833-F-11-008.

Silt fence fabrics (geotextiles) tested in laboratory settings have been shown to be effective at trapping sediment particles. However some field tests of silt fences installed at construction sites, have shown generally poorer results. In these studies, effectiveness testing involved measurements for both total suspended solids and turbidity. Other studies and articles about silt fence usage and practice document problems with installation and maintenance, implying poor performance.

Since at least the year 2000, static slicing the material into the ground has been widely adopted. In 2000 the U.S. Environmental Protection Agency (EPA) co-sponsored silt fence efficacy field research through its Environmental Technology Verification Program, and in general, the report found the static slicing method to be highly effective, and efficient. It has been proposed by some that silt fence effectiveness is best determined by how many hundreds of pounds of sediment are contained behind a given silt fence after a storm event, and not turbidity, etc. as sediment-retention is the end goal, and not a water-quality measurement used in erosion control, for instance.

Silt fences may perform poorly for a variety of reasons, including improper location (e.g. placing fence where it will not pond runoff water), improper installation (e.g. failure to adequately embed and backfill the lower edge of fabric in the soil) and lack of maintenance—fabric falling off of the posts, or posts knocked down. During various phases of construction at a site, a silt fence may be removed relocated and reinstalled multiple times. See Brzozowski, Carol (November-December 2006). "Silt Fence Installation". *Erosion Control*. Forester Media. 13 (7).

For more robust applications a "super silt fence" was developed. The Super silt fence is, historically, a combination of chain link and a geotextile, commonly a synthetic woven filtration fabric. Super silt fencing is used to control extreme erosion, or to protect slopes, as well as to provide additional protection for waterways, minimizing the impact during construction activities.

The broader categorization of the super silt fence is a reinforced silt fence in which the geotextile is reinforced with separate elements, like the chain link fence in the "super silt fence" described above. Silt fences using nonwoven geotextiles reinforced with straps or belts of reinforcing material have also been proposed and utilized for the last twenty years. Others have proposed and popularized a scrim backing layer as a reinforcing layer to form a composite multilayer geotextile silt fencing with two or three layer structures. The chain link fenced backed super silt fence, the belted silt fence and the composite layer silt fence can also be identified as high performance silt fences which provide additional protection for waterways than conventional silt fences, minimizing the impact during construction activities.

It is one object of the present invention to provide a non-woven composite geotextile silt fence as a high performance silt fence.

SUMMARY OF THE INVENTION

This invention is directed to a cost effective, efficient, and easy to implement silt fence including a plurality of spaced stakes; and a nonwoven needle punched geotextile including a combination of a synthetic fiber blend and natural fibers, wherein the synthetic fiber blend includes a blend of polypropylene fibers and high tenacity polyester fibers.

Another aspect of the invention is directed to a nonwoven needle punched geotextile comprising at least 40% by volume of a synthetic fiber blend including a blend of polypropylene fibers and high tenacity polyester fibers; and at least 40% by volume of a natural fiber blend that includes at least two of kenaf, jute, hemp, lyocell, cotton, sisal, abaca, coir, flax and ramie.

One aspect of the invention provides a trenchless method of installing a silt fence for erosion, sediment and pollution control, comprising the steps of: providing a silt fence bundle comprising a plurality of spaced wooded or metal stakes and a nonwoven geotextile silt fence fabric coupled to the spaced wooded or metal stakes and including an integral ground engaging apron; driving the plurality of spaced wooded or metal stakes into the ground until the integral ground engaging apron is flush with the ground; and staking the ground engaging apron to the ground with staking elements.

These and other aspects of the present invention will be clarified in the description of the preferred embodiment of the present invention described below in connection with the attached figures.

DESCRIPTION OF THE FIGURES

FIG. 10 is a perspective schematic view of an inside corner formed with the trenchless installation method according to one embodiment of the present invention.

FIG. 12 is a plan view of a chiseled tip on a plate for providing side fins for the stakes of the silt fence of the invention that are to be driven into the ground.

DESCRIPTION OF THE PREFERRED EMBODIMENTS

Figure 1:
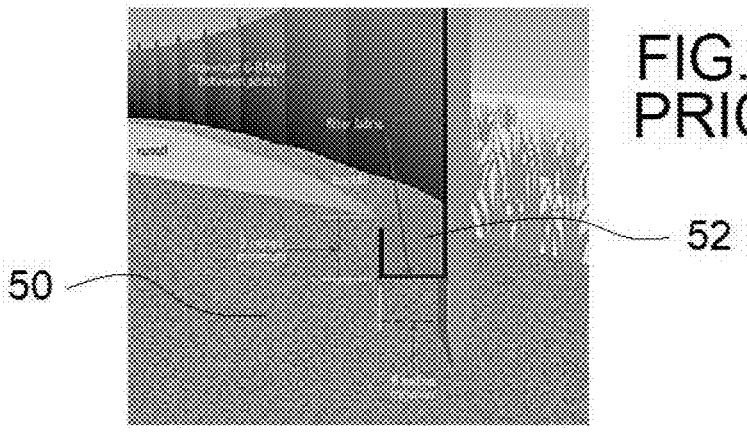
FIG. 1 PRIOR ART
FIG. 1 is a perspective schematic section view of a prior art trenched silt fence.

The present invention is directed to a silt fence 10 including a plurality of spaced stakes 30; and a nonwoven needle punched geotextile 20 coupled to the stakes such as by staples 32 and wherein the geotextile includes a combination 28 of a synthetic fiber blend 26 and natural fibers 22, wherein the synthetic fiber blend 26 includes a blend of polypropylene fibers and high tenacity polyester fibers. The stakes 30 provided at regular intervals such as 4' or 5' intervals. Where the stakes 30 are wood, ¼"×1" staples are effective as fasteners 32. Where the stakes 30 are metal posts, such as T-posts shown in FIG. 9, wire ties or zip ties may be used for fasteners 32.

Nonwoven Geotextile 20

The nonwoven needle punched geotextile 20 includes a combination 28 of a synthetic fiber blend 26 and natural fibers or natural fiber blend 22 as noted above. The natural fibers 22 of the geotextile 20 include at least one of kenaf, jute, hemp, lyocell, cotton, sisal, abaca, coir, flax and ramie. Preferably the natural fibers 22 of the geotextile 20 are in a natural fiber blend 22 that includes at least two of kenaf, jute, hemp, lyocell, cotton, sisal, abaca, coir, flax and ramie. Most preferably the natural fiber blend 22 of the geotextile includes at least kenaf and jute.

Figure 2:
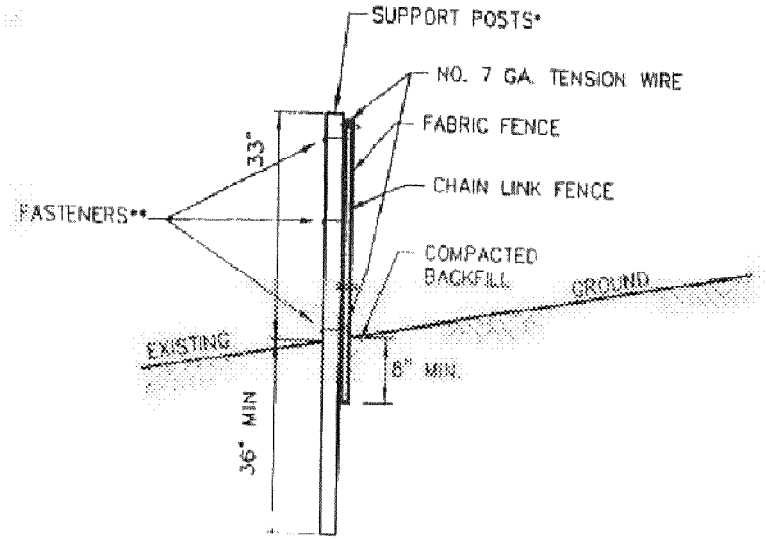
FIG. 2 PRIOR ART
FIG. 2 is a schematic section view of a prior art trenched super silt fence.
Figure 3:
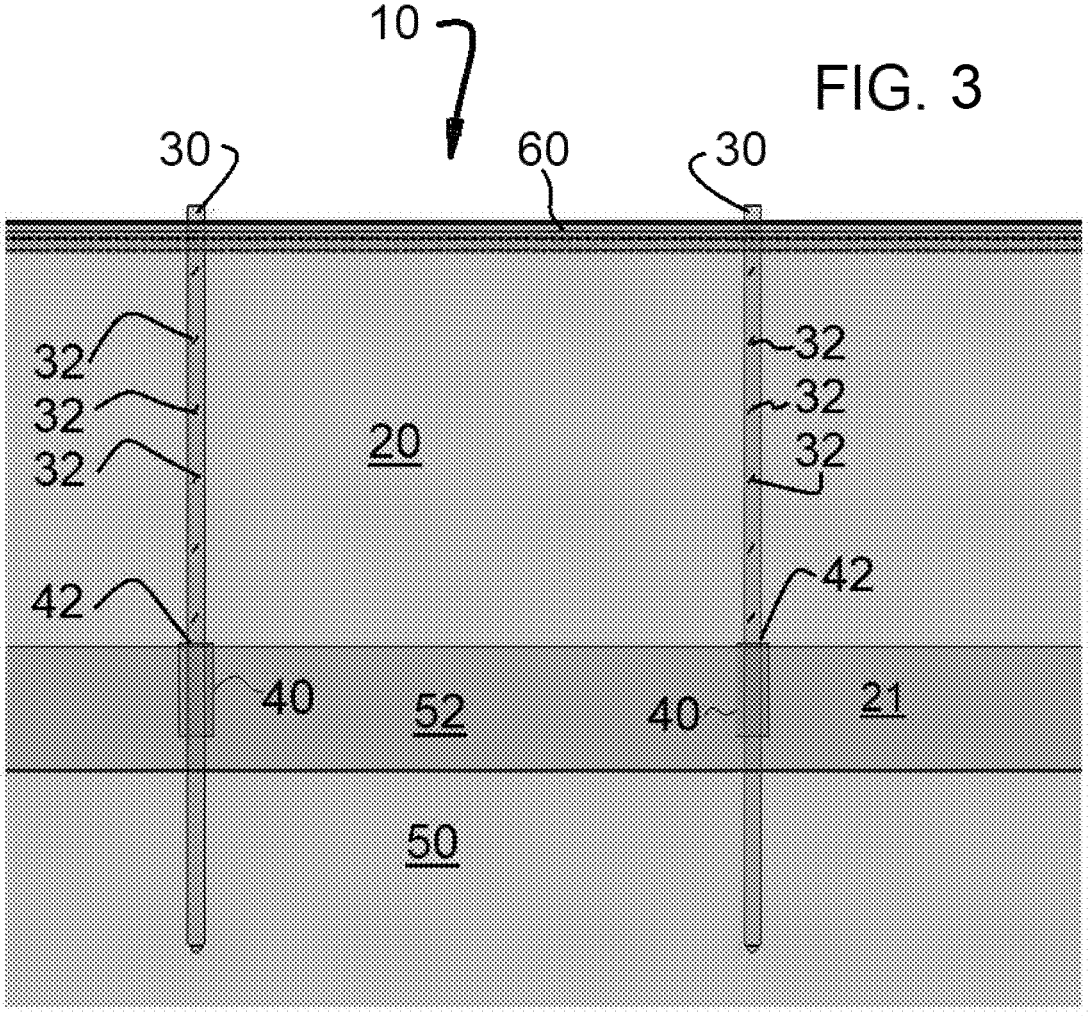
FIG. 3 is a front elevation schematic view of a belted, nonwoven geotextile silt fence with stabilizing features according to one embodiment of the invention.
Figure 4:
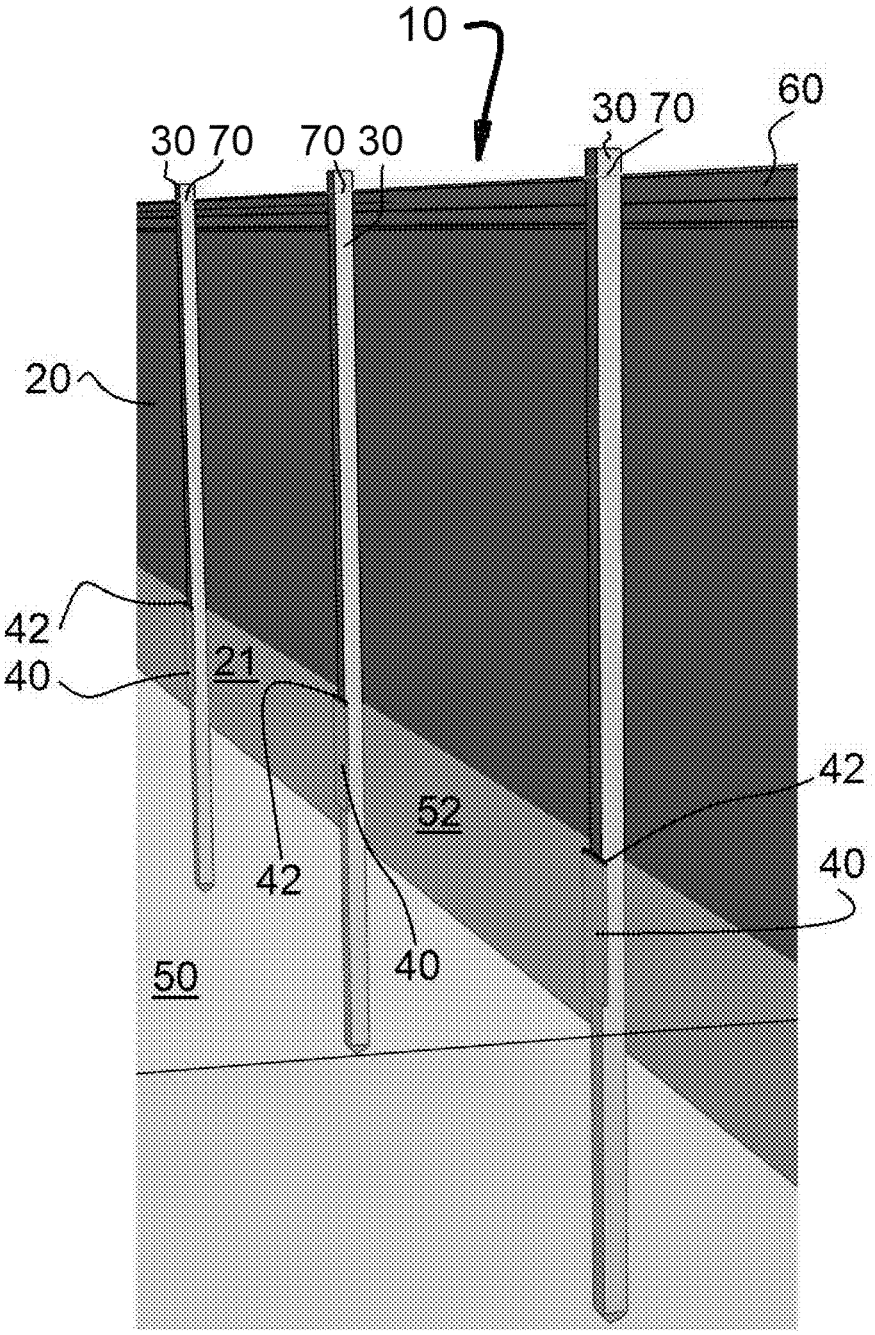
FIG. 4 is a perspective section schematic view of a belted, nonwoven geotextile silt fence with stabilizing features according to one embodiment of the invention.
Figure 5:
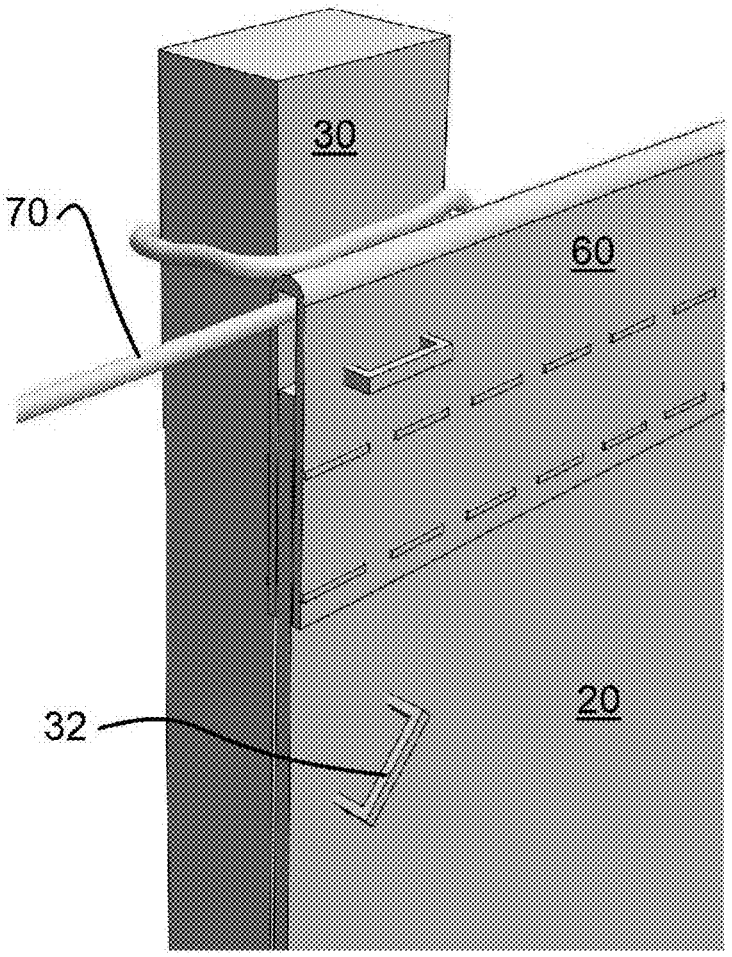
FIG. 5 is an enlarged schematic perspective view of the nonwoven geotextile silt fence according to one embodiment of the invention with a portion of the silt fence removed for clarity.

The lower portion 21 of the fabric 20 forming the fence 10 is from where the fence fabric 20 engages the ground 50. In the trench version of the fence shown in FIGS. 2 and 3 this portion 21 is within the trench 52, extending at least to the bottom of the trench 52, possibly also along the bottom of the trench 52 and even up the distal side as known in the art (See prior art configuration for possible placement of the portion 21). In the trenchless version of the fence 10 shown in FIGS. 8-11 the lower portion forms a ground engaging apron 21 for the fence 10 discussed below.

An effective natural fiber blend 22 is formed wherein the natural fiber blend 22 of the geotextile 20 is formed in about a 1 to 1 ratio of kenaf to jute by volume. The term about will reference +/−5% herein unless noted otherwise. The Kenaf fibers generally have a fiber length is from about 2-6 mm. The Kenaf fibers generally have a diameter from about 17 to 22 micron. The Kenaf fibers generally have a density of about 1.2-1.4 g/cm$^3$, and an elongation of about 1.6%. The Jute fibers generally have a fiber length is from about 2-20 mm. The Jute fibers generally have a diameter from about 17 to 20 micron. The Kenaf fibers generally have a density of about 1.4-1.5 g/cm3, and an elongation of about 1.0-1.8%. The natural fiber blend 22 is mixed to form a homogenous blend 22 before combined (28) with the synthetic blend 26 for needle punching 80.

Figure 6:
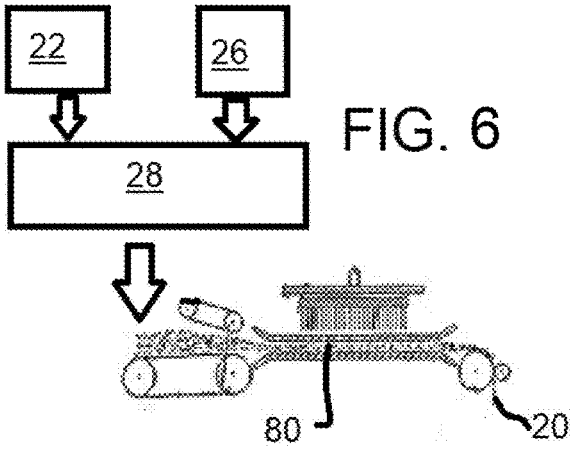
FIG. 6 is a schematic view of the needle punching manufacturing process of the nonwoven geotextile for the nonwoven geotextile silt fence according to one embodiment of the invention.

The synthetic fiber blend 26 of the geotextile 20 is formed in about a 4 to 1 ratio of polypropylene fibers and high tenacity polyester fibers by volume. The polypropylene fibers and high tenacity polyester fibers of the geotextile 20 are each about 6 denier and about 100 mm in length. The synthetic blend 26 is mixed to form a homogenous blend 26 before combined at 28 with the natural fiber blend 22 for needle punching 80. Needle punching 80 is shown schematically in FIGS. 6 and 7 and is a type of mechanical engagement of the fibers to form the web or sheet of material 20. In mechanical bonding the strengthening of the web (sheet product 20) is achieved by inter-fiber friction as a result of the physical entanglement of the fibers. In needle punching specially designed needles are pushed and pulled through the web to entangle the fibers and form the nonwoven geotextile 20.

Polypropylene (PP) is the first stereo-regular polymer to have achieved industrial importance. The fiber from Polypropylene were introduced to the textile arena in the 1970s and have become an important member of the rapidly growing family of synthetic fibers. Polypropylene is a linear structure based on the monomer $CnH_2n$. It is manufactured from propylene gas in presence of a catalyst such as titanium chloride and is a by-product of oil refining processes. Polypropylene chips can be converted to fiber/filament by traditional melt spinning, though the operating parameters need to be adjusted depending on the final products. Spunbonded and melt blown processes are also very important fiber producing techniques for nonwovens. The polypropylene fibers for the synthetic blend 26 of the geotextile 20 are about 6 denier and about 100 mm in length.

Polyester is a long-chain polymer fiber derived from coal, water and petroleum. At least 85% of its weight consists of an ester plus dihydric alcohol and terephthalic acid. The fiber was developed during the Second World War, and the resultant fiber was called Terylene; the material was commercially manufactured in the United States by DuPont by 1951 and called Dacron. Since 1951, polyester has been developed and engineered to produce specific properties.

Tenacity a term used in textiles to describe the strength of a fiber. It refers to the ability of a fiber to resist breaking or stretching when it is subjected to tension or stress. In other words, it measures the amount of force that is required to break a fiber. The tenacity of a fiber is determined by its molecular structure and the way that its molecules are arranged. Fibers that have a high degree of crystallinity and are tightly packed together tend to be more tenacious than fibers that have a less ordered structure. The length and diameter of a fiber also affect its tenacity, as longer and thicker fibers tend to be stronger than shorter and thinner fibers. The tenacity of a fiber is typically measured in grams per denier (g/d). Denier is a unit of measurement that is used to describe the thickness of fibers, and it is equal to the weight in grams of 9,000 meters of the fiber. So, a fiber with a tenacity of 5 g/d means that it can withstand a load of 5 grams per 9,000 meters of the fiber.

A high tenacity polyester fiber is defined herein as one with a tenacity of at least 6.5 g/d. Preferably greater high tenacity polyester fiber has a tenacity greater than 8.0 g/d, and more preferably 9 g/d or higher, is generally prepared by changing various process parameters, such as a spinning temperature, a quench air temperature, a temperature of godet rollers and a velocity ratio thereof, and the like. Particularly, a method of minimizing orientation of an undrawn fiber before drawing process is used in the preparing process of an industrial polyester fiber so as to reveal the properties in the fiber-making processes (synthesis of raw materials, polymerization, and spinning).

The synthetic fiber blend 26 forms at least 40% of the geotextile 20 by volume and the natural fibers or fiber blend 22 forms at least 40% of the geotextile 20 by volume. Preferably the ratio of the synthetic fiber blend 22 and the natural fibers or blend 22 is about 1 to 1 by volume. The weight of the geotextile is about 28 oz/yd$^2$.

The silt fence 10 formed by the geotextile 20 described herein exhibits a dynamic apparent opening size (AOS) under load. Apparent opening size (AOS) is an important parameter in assessing a geotextile's soil filtration capability. For measuring AOS of a geotextile, spherical solid glass beads are dry sieved through a geotextile for a specified time and at a specified frequency of vibration. The amount of beads retained by the geotextile sample is then measured. The test is carried out on a range of sizes of glass beads. The apparent opening size is the pore size at which 90% of the glass beads are retained on and within the fabric. The geotextile 20 described herein exhibits a dynamic apparent opening size (AOS) under load, specifically under water pressure the geotextile 20 will having an increasing AOS and thus improving the operational characteristics of the silt fence 10. Specifically, the fence 10 will exhibit a standard AOS allowing water to flow at a specific rate but as water ponds or collects on the upstream side the increasing pressure will slightly increase the AOS of the fabric 20 of fence 10, essentially when such is needed.

The fibers forming the geotextile 20 of the present invention are selected based upon their strength, longevity, pollution affinity and UV resistance. The natural fiber blend 22 is primarily selected to define the fiber density or fiber matrix of the geotextile 20 and for the pollution affinity of the geotextile 20. The synthetic fiber blend 26 is primarily responsible for the strength, longevity and UV resistance of the geotextile 20.

The nonwoven needle punched geotextile 20 is compressible within slit trench 52 installations wherein the compression of the geotextile 20 within the trench 52 limits vertical water transmissivity by at least 50%. In other words the ability of the geotextile 20 to transmit water vertically is typically cut in half at the location of the soil/trench 52 because the geotextile 20 of fence 10 is compressed by the soil during installation and the ability to transmit water below is restricted. This aspect minimizes undercutting of the silt fence 10 in the field.

The nonwoven needle punched geotextile 20 is also particularly well suited for trenchless installations, as the apron 21 can be secured effectively to the ground 50 without ripping or tearing.

Belting 60

The nonwoven needle punched geotextile 20 may include a top reinforcing element or belt 60. The top belt 60 also serves as a visual indicator of the top of the fence 10. If this is made from a high visibility color, such as yellow or red or neon green or the like, it will add another safety feature minimizing the accidental interference with the silt fence during construction activity (e.g., the fence 10 is less likely to be accidentally run over with construction equipment or have construction material accidentally stored thereon). The minimizing the knocking over of the silt fence 10 can also be broadly categorized as a stabilizing feature of the silt fence 10.

It is also anticipated as a possibility to place a belting element 60 at the leading end of the apron 21 for trenchless implementations, if the belting material 60 better conforms to the ground 50 with staking elements 82.

Top Drawstring 70

The present invention is directed to a nonwoven geotextile 20 based silt fence 10 with stabilizing features. Another stabilizing feature is the inclusion of a tensioning drawstring 70 at the top of the silt fence 10. The tensioning drawstring 70 is an elastic cord at the top of the fence 10, coupled to the geotextile 20, which may be used to selectively tension, or re-tension, the silt fence 10 to remove sagging and stabilize the silt fence 10.

In operation, after use or high rain events select portions of the geotextile 20 of the fence 10 may become stretched and sag between adjacent stakes 30. If left in a sagging condition the effective height of the silt fence 10 is reduced and the silt fence 10 may fail in heavy flow events. In other words, groundwater may more easily flow over the sagging fence 10. The drawstring 60 at the top of the fence 10 allows for easy tensioning (un-sagging) of the silt fence 10. A worker maintaining the fence 10 can merely walk along the fence 10 and at location of excessive sagging the drawstring 70 is accessed and wrapped further around the stake 30 at the sagging locations one or more times to remove the sag.

A simple method of attaching the tensioning elastic cord forming the drawstring 70 to the top of the geotextile 20 is to have the top belt 60 formed as a coupling strip, namely constructed as a 4" wide strip of material folded over the top of the geotextile (sticking up about ¾") 20 and sewn thereto, thereby creating a tubular passageway containing the drawstring 70. Openings are provided in the belt/coupling strip 60 at or near the stakes 30 to allow the worker to access and pull the drawstring 70 out from the inside of the tube formed by the coupling strip 60, to wrap around the stake 30 for removing of the sag in the geotextile 20. The openings in the belt/coupling strip 60 may be provided after the attachment of the coupling strip 60 to the geotextile 20 during the assembly process. Alternatively, a line of openings spaced every two inches or so may be provided in the reinforcing belt/coupling strip 60, whereby there will always be an opening at or near a stake 30 regardless of the alignment of the coupling strip 60 with the geotextile 20 and/or stakes 30 during assembly.

Stakes 30

Figure 9:
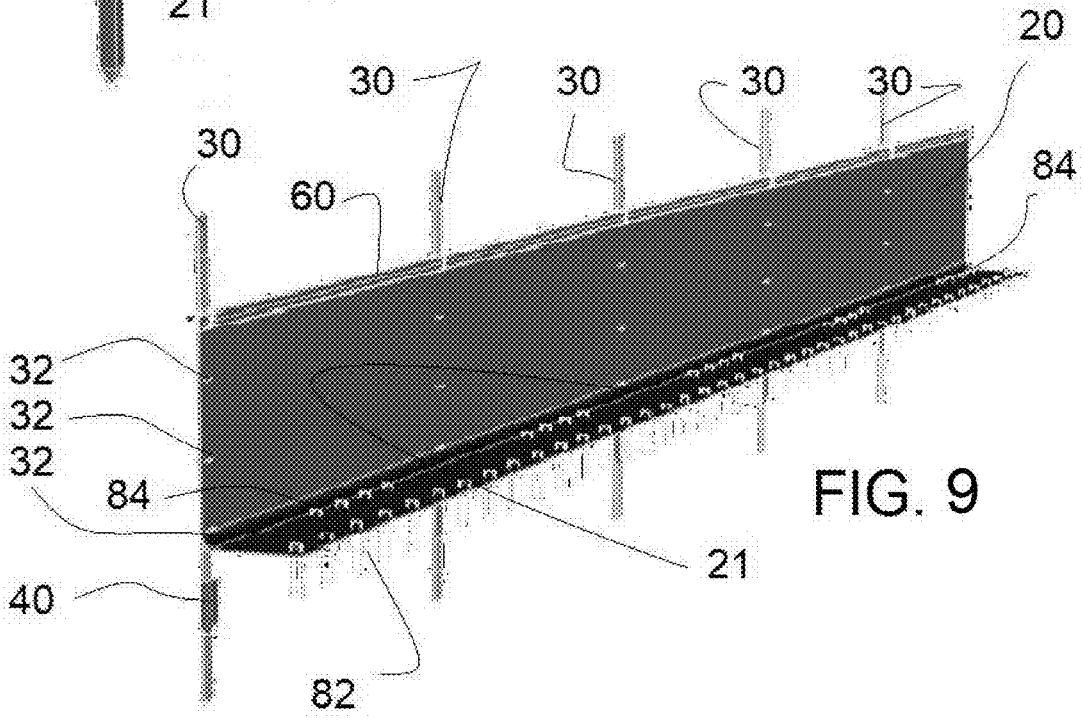

The silt fence 10 will include the nonwoven geotextile 20 coupled to stakes 30, preferably wooden, via staples 32 or the like, with the stakes preferably spaced at 4' intervals. Hardwood stakes 30 about 1½" wide form a cost effective efficient selection for the fence 10 of the present invention. Heat treatment of the wood forming the stakes 30 has been found to increase the shelf life and field life of the stakes, but generally such additional processing is not required. Further metal stakes 30 may be utilized as shown in FIG. 9, but the increase in costs is not generally advantageous.

Stabilizing Fins

The nonwoven geotextile 20 based silt fence 10 with stabilizing features further includes stabilizing fins formed by a plate body 40 with a bury depth indicator 42. The stabilizing fins are easily formed by attaching a plastic rectangular plate body 40 to selective, possibly all, stakes 30 opposite the side coupled to the nonwoven geotextile 20. The length of the plate body 40 is preferably less than the depth of a conventional silt fence trench 52 in the ground 50 and the width is less than 2 times the width of the stake 30, preferably about 1.9 times the width of the stake 30. This size makes the fins effective but not unwieldy or costly. The plate 40 will engage the wall of the trench 52 during installation and the fins (the portion of the plate body 40 extending laterally beyond the stake 30) will add a stabilizing resistance preventing the fence 10 or stakes 30 from being pushed over and out of position by ponding water and the like on the fabric 20 or on the fence 10 overall.

In addition to the stabilizing fins, the top horizontal surface 42 of the plate body 40 acts as a visual bury depth indicator for the stake 30. Users can quickly visually see how far to position the stake 30 in the ground, namely when the top surface 42 of the plate body 40 (top surface of the fins) is even with the ground in the trench 52. As the fins and plate body 40 is less than the depth of the trench 52 in the ground 50 the plate body 40 does not increase insertion resistance for the stake 30, and a rectangular shape for the plate body 40 is effective without causing other detrimental problems.

The plate body 40 may be wood, metal or plastic and may be stapled, nailed or otherwise attached to the individual stakes 30, preferably wooden stakes.

Trenchless Stapled Apron Version

One of the main purposes of any silt fence is to prevent the unwanted migration of disturbed soil during construction. The trench 52 that buries the lower part 21 of the fabric 20 of the fence 10 is utilized to prevent water creating a path under the fence 10 bypassing the fabric 20. However, this installation process creates extra disturbed soil that adds to the disturbed soil load of the fence 10. More significantly, this installation requires trenching tools and labor.

FIGS. 8-11 show a trenchless installation of the fence 10 that minimizes the installation time and soil disturbance without effecting operation of the fence 10. There are several advantages to the trenchless installation shown in FIGS. 8-11. The first is the equipment needed to install the fence is merely sledgehammer, utility knife, and staple guns for staples 32 (or tool for wire ties if used) and apron staples 82, 84 and 86 (discussed below). There is no trenching equipment required or disturbed soil.

Figure 8:
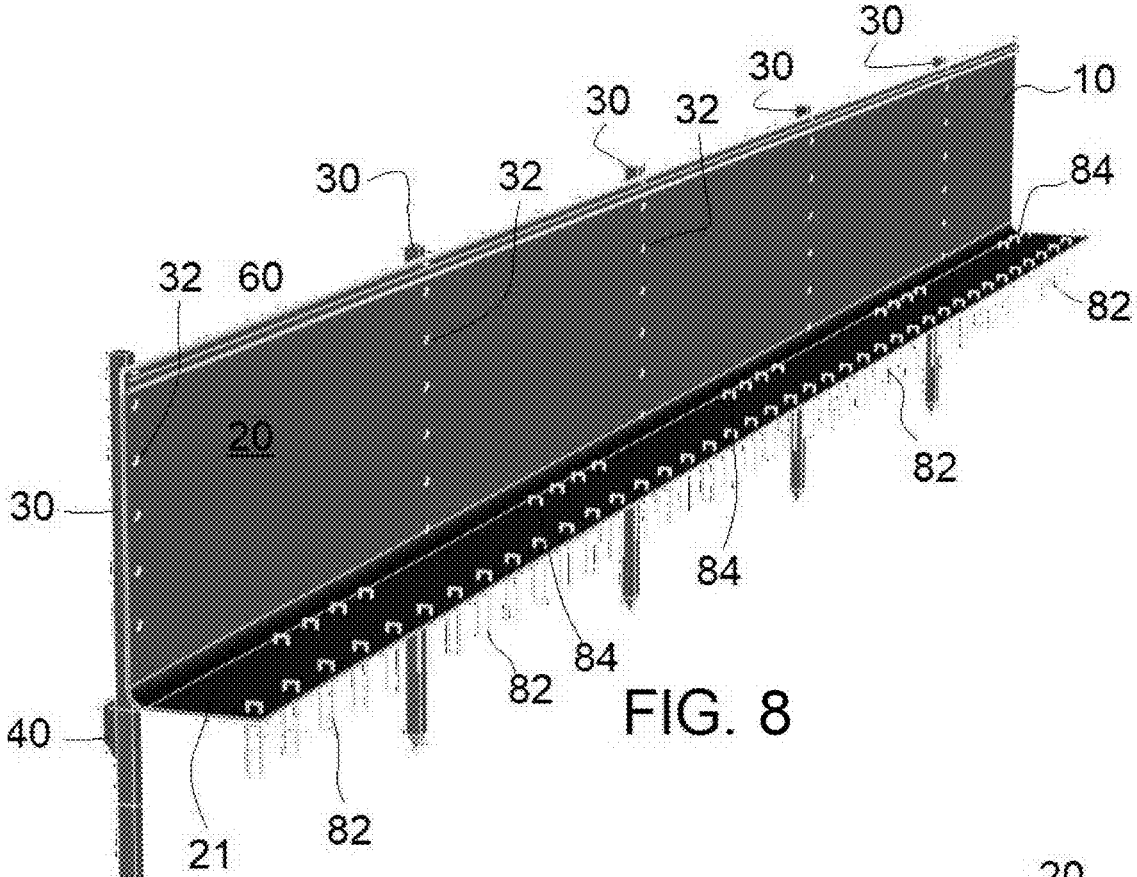
FIGS. 8 and 9 are schematic perspective views of the geotextile silt fence according to trenchless implementations of the invention.

In the trenchless installation the stakes 30 are driven into the ground with a sledge hammer, and as shown in FIG. 8 the top surface 42 of the plates can also be used as a depth of driving guide. The plates 40 may be positioned without the top surface 42 forming a guide so as to be completely buried as shown in FIG. 9. In this method of installation the plate 40 preferably is beveled on the bottom as the stakes 30 will be driven into the soil 50. A preferred shape for plates 40 when the stakes are driven into the ground such as in a trenchless installation is shown in FIG. 10. The plate 40 still provides stabilizing fins for the fence 10. FIG. 8 shows preferred wooded stakes 30 with staples 32 as fasters 32, while FIG. 9 shows the use of metal t-posts forming stakes 30 and wire ties for fasteners 32.

With the stakes 30 driven into the ground 50, the lower portion 21 forms a ground engaging apron that is secured to the ground through staking elements 82, 84 and 86. The plurality of spaced wooded or metal stakes 30 are driven into the ground until the integral ground engaging apron 21 is flush with the ground 50. Preferably the staking elements 82, 84 and 86 are 1"×6" staples. The apron 21 is preferable about 12" in length. The staking elements 82, 84 and 86 include a line of staples 82 evenly spaced along the leading edge (the distal edge of the fabric 20) of the apron 21 with about 6" proving to be an effective distance. The distal end of the fabric 20 is the end spaced from the top having the tensioner 70 and coupling strip 60, which is considered the leading end of the apron 21 as it faces the upstream side of ground 50. The staking elements 82, 84 and 86 include a groupings of about four staples 84 evenly spaced along the trailing edge of the apron 21. The trailing edge of the apron 21 is spaced about 12" up from the distal end of the fabric 20, and about 6" between the staples 84 in the grouping proving to be an effective distance and the grouping being centered between the stakes 30. The staples 82 and 84 are preferably positioned perpendicular to the line of the fence 10 whereby the head of the staples extend generally perpendicular to the plane of the upper portion of the fabric 20 on the stakes 30.

Figure 11:
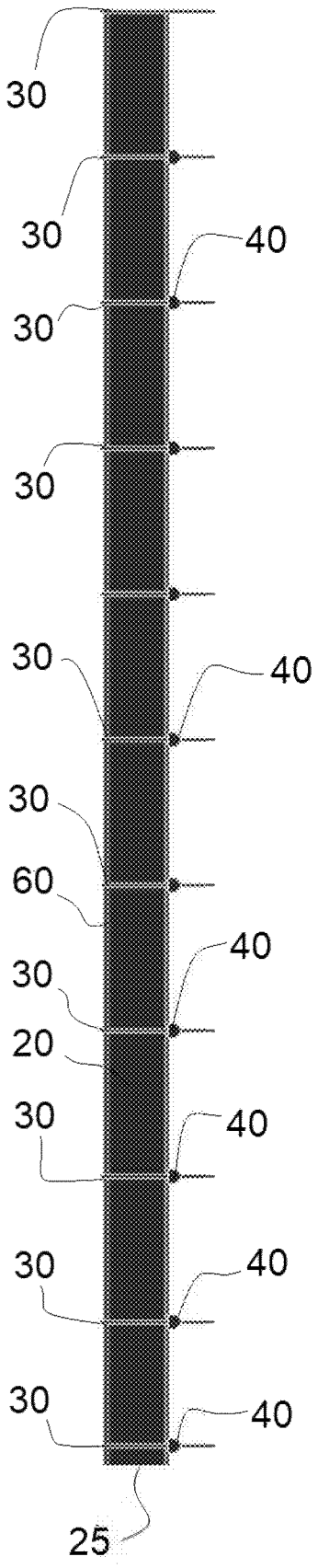
FIG. 11 is an elevated plan view of a 50' pre-staked bundle of a geotextile silt fence and 5' stakes according to one embodiment of the invention.

The staking elements 82, 84 and 86 include a groupings staples 86 spaced along overlapping portions of apron 21. FIG. 10 is a perspective schematic view of an inside corner of the fence 10 formed with the trenchless installation method according to one embodiment of the present invention. The user cuts the apron 21 at 23 and overlaps the apron in the inside corner and adds staples 86 to hold down the overlapped portion. FIG. 11 is an elevated plan view of a 50' pre-staked bundle of a geotextile silt fence with stabilizing features and 5' stakes according to one embodiment of the invention showing a flap 25 on one edge of the bundle. When adding a second bundle for a fence installation the flap 25 of one section is overlapped with the other end (stake 30 without plate 40) and the a grouping of staking elements 86 will be used in the overlapped portion. Further the upper portion of the flap can be coupled to the end stake of the adjacent bundle via staples 32 (generally ¼"×1").

The fabric 20 of the fence 10 is particularly well suited for trenchless installation but this method may be applicable to other silt fences assuming they can achieve a solid engagement with the ground and prevent water from undercutting beneath the fence 10.

Figure 7:
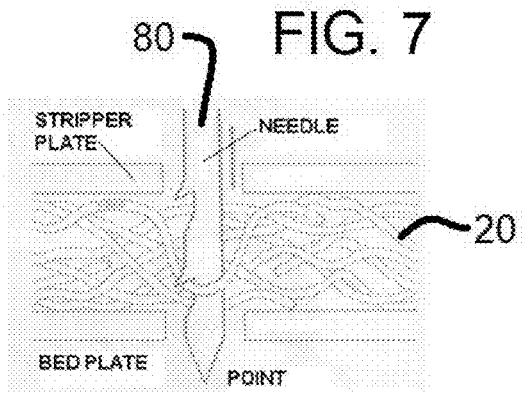
FIG. 7 is an enlarged schematic view of the needle punching operation forming the geotextile of the silt fence of the invention.

As noted FIG. 7 shows the use of metal t-posts forming stakes 30 and wire ties for fasteners 32. The metal posts or stakes 30 are well suited for an alternative trenchless installation in which the unbundled stakes 30 (no fabric 20 yet attached) are driven into the ground and the fabric 20 with apron 21 is later attached to the stakes 30 in situ with ties as fasteners 32 and the apron 21 is secured to the ground 50 staking elements 82, 84 and 86 as discussed above. The in situ installation may also be used with wooden stakes 30.

It is apparent that many variations to the present invention may be made without departing from the spirit and scope of the invention. The present invention is defined by the appended claims and equivalents thereto.

What is claimed is:

1. A silt fence comprising:

a plurality of spaced stakes; and a nonwoven needle punched geotextile including a combination of a synthetic fiber blend and natural fibers, wherein the synthetic fiber blend includes a blend of polypropylene fibers and high tenacity polyester fibers, wherein the synthetic fiber blend of the geotextile is formed in about a 4 to 1 ratio of polypropylene fibers to high tenacity polyester fibers by weight.

2. The silt fence of claim 1 wherein the natural fibers of the geotextile include at least one of kenaf, jute, hemp, lyocell, cotton, sisal, abaca, coir, flax and ramie.

3. The silt fence of claim 1 wherein the natural fibers of the geotextile are in a natural fiber blend that includes at least two of kenaf, jute, hemp, lyocell, cotton, sisal, abaca, coir, flax and ramie.

4. The silt fence of claim 3 wherein the natural fiber blend of the geotextile includes at least kenaf and jute.

5. The silt fence of claim 4, wherein the natural fiber blend of the geotextile is formed in about a 1 to 1 ratio of kenaf to jute by weight.

6. The silt fence of claim 1 wherein the polypropylene fibers and high tenacity polyester fibers of the geotextile are each about 6 denier and about 100 mm in length.

7. The silt fence of claim 6 wherein the weight of the geotextile is about 28 oz/yd$^2$.

8. The silt fence of claim 1 wherein the high tenacity polyester fibers are each about 6 denier and about 100 mm in length.

9. The silt fence of claim 1 wherein the synthetic fiber blend forms at least 40% of the geotextile by volume and the natural fibers forms at least 40% of the geotextile by volume.

10. The silt fence of claim 1 wherein the geotextile exhibits a dynamic apparent opening size under load.

11. The silt fence of claim 1 wherein the nonwoven needle punched geotextile is compressible within slit trench installations wherein the compression limits vertical water transmissivity by at least 50%.

12. The silt fence of claim 1 further including a reinforcing belt at a top of the geotextile and a tensioning drawstring within the reinforcing belt at a top of the geotextile.

13. A nonwoven needle punched geotextile comprising at least 40% by volume of a synthetic fiber blend including a blend of polypropylene fibers and high tenacity polyester fibers, wherein the synthetic fiber blend of the geotextile is formed in about a 4 to 1 ratio of polypropylene fibers to high tenacity polyester fibers by weight; and at least 40% by volume of a natural fiber blend that includes at least two of kenaf, jute, hemp, lyocell, cotton, sisal, abaca, coir, flax and ramie.

14. The nonwoven needle punched geotextile according to claim 13, wherein the natural fiber blend of the geotextile includes at least kenaf and jute, and wherein the natural fiber blend of the geotextile is formed in about a 1 to 1 ratio of kenaf to jute by weight.

15. The nonwoven needle punched geotextile according to claim 14, wherein the polypropylene fibers and high tenacity polyester fibers are each about 6 denier and about 100 mm in length.

16. The nonwoven needle punched geotextile according to claim 15, wherein the weight of the geotextile is about 28 oz/yd$^2$.

17. The nonwoven needle punched geotextile according to claim 13, wherein the polypropylene fibers and high tenacity polyester fibers are each about 6 denier and about 100 mm in length.

* * * * *